United States Patent [19]

Kortick

[11] 4,321,723

[45] Mar. 30, 1982

[54] TRAVEL HAIR BRUSH

[76] Inventor: Leonard R. Kortick, 88 Waldren Ave., Cranston, R.I. 02910

[21] Appl. No.: 151,192

[22] Filed: May 19, 1980

[51] Int. Cl.[3] ..... A46B 9/10

[52] U.S. Cl. ..... 15/184; 15/203

[58] Field of Search ..... 15/184, 203; 132/120, 132/121, 123, 85

[56] References Cited

U.S. PATENT DOCUMENTS

| | | | |
|---|---|---|---|
| 1,141,662 | 6/1915 | Bridges | 15/203 |
| 2,064,557 | 12/1936 | Lee | 15/184 |
| 2,792,582 | 5/1957 | Gray | 15/203 |
| 2,981,965 | 5/1961 | Kaye et al. | 15/203 |
| 3,086,236 | 4/1963 | Anonsen | 15/203 |
| 4,214,340 | 7/1980 | Youngberg et al. | 15/184 |

*Primary Examiner*—Peter Feldman

*Attorney, Agent, or Firm*—Max Schwartz; Herbert B. Barlow, Jr.

[57] ABSTRACT

A compact hair brush particularly suitable for traveling. A flat housing is provided with a plurality of rows of transversely mounted bristles. Each row of bristles is individually mounted on a pivoted bar. A longitudinal operating rod pivotally connects to each bar above the pivot point. Longitudinal movement of the bar causes a 90° pivotal movement of the bars. A manually engageable portion of the rod extends out of the housing for operating the rod. After the housing is opened to expose the bristles, the rod is operated to pivot the bars and cause the bristles to stand up in vertical operating position. The brush is now ready for use. Reversely, the rod is operated to pivot the bars and cause the bristles to lie flat in the housing. This permits closing the substantially flat housing. The construction lends itself to many variations in the housing. The manually engageable rod may be positioned in various portions of the housing depending on the design used.

5 Claims, 10 Drawing Figures

TRAVEL HAIR BRUSH

BACKGROUND OF THE INVENTION

Travel brushes are popular and designed to take up a minimum of space. Conventionally, the brush comprises a flat back without a handle and fixed bristles of minimum height. A separate case may be provided to house the brush and protect the bristles. The result is very little saving of space. The brush is slightly flatter than a conventional hairbrush, perhaps a little smaller in area, and without a handle. Where a case is used, the space saved is minimal.

SUMMARY OF THE INVENTION

The present invention provides a travel hair brush which is small and compact and saves considerable space. The brush of the present invention combines the brush and case therefore in a single unitary compact construction. A flat housing is provided with a plurality of rows of transversely mounted bristles. Each row of bristles is individually mounted on a pivoted bar so that when the bars are pivoted on one directions the bristles lie flat in the case to take up a minimum of space and when the bars are pivoted in the opposite direction the bristles stand vertically ready for use. A longitudinal operating rod is reciprocally mounted in the housing and pivotally connects with each bar to cause them to pivot together when the rod is actuated. A manually engageable portion of the rod extends out of the housing. The housing is provided with a cover for covering the bristles when they are lying flat in the housing. After the cover is opened, the rod is actuated to pivot the bars and cause the bristles to stand vertically for use. Reversely, the rod is actuated to cause the bristles to pivot flat into the housing and the cover is closed to provide a flat, small, enclosed case suitable for traveling.

DESCRIPTION OF THE INVENTION

Figure 1:
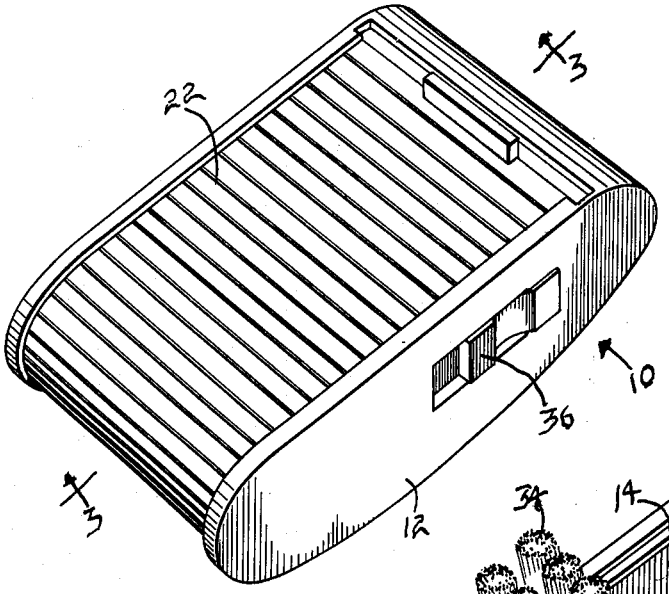
FIG. 1 is a perspective view of a travel brush and case of the present invention in closed position.
Figure 2:
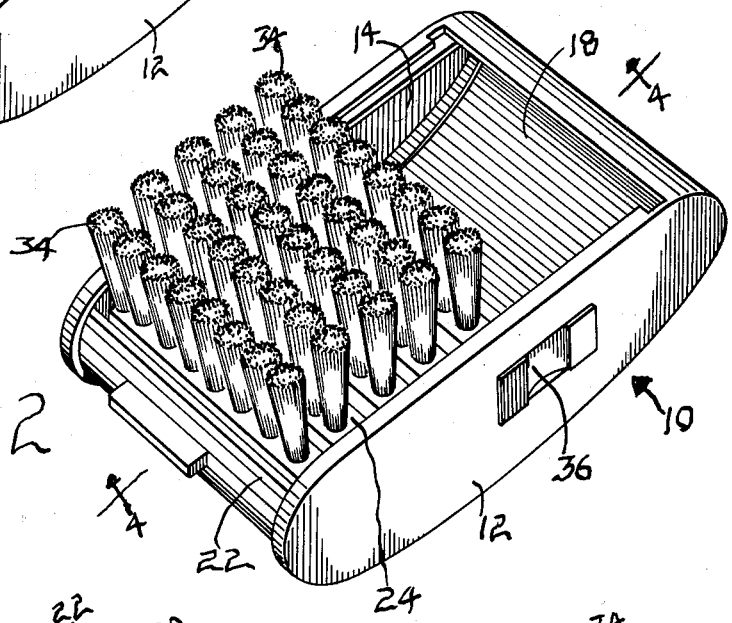
FIG. 2 is a perspective view of the brush in open position.
Figure 3:
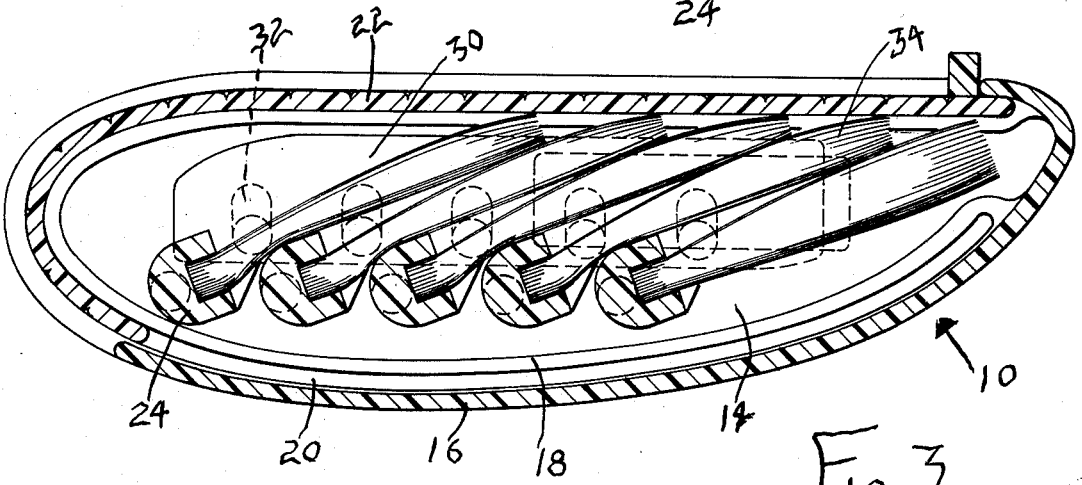
FIG. 3 is an enlarged section taken on line 3—3 on FIG. 1.
Figure 4:
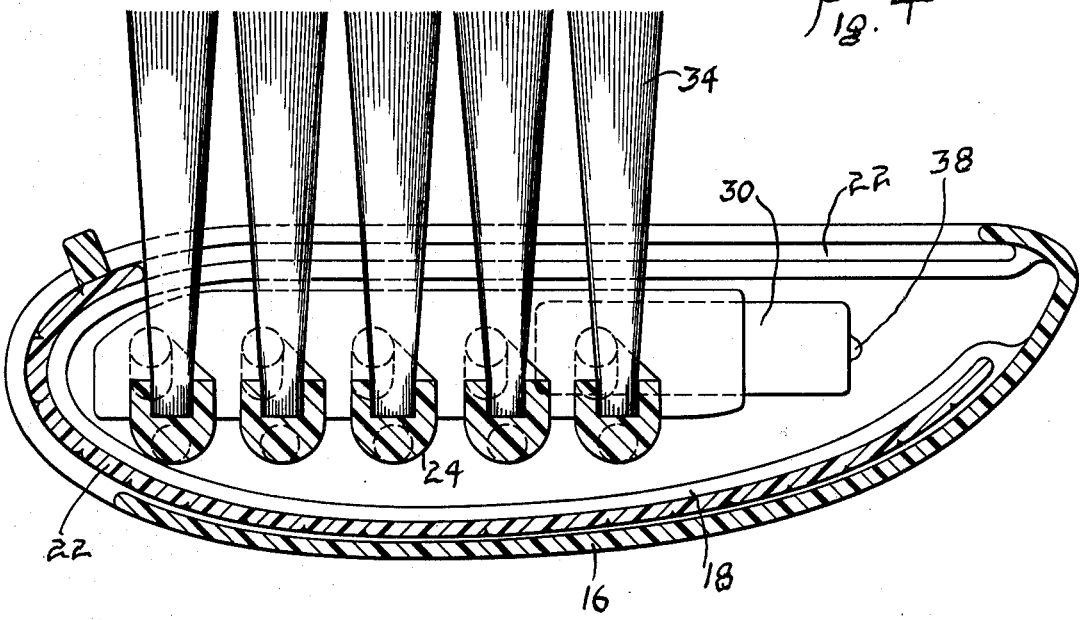
FIG. 4 is an enlarged section taken on line 4—4 on FIG. 2.
Figure 5:
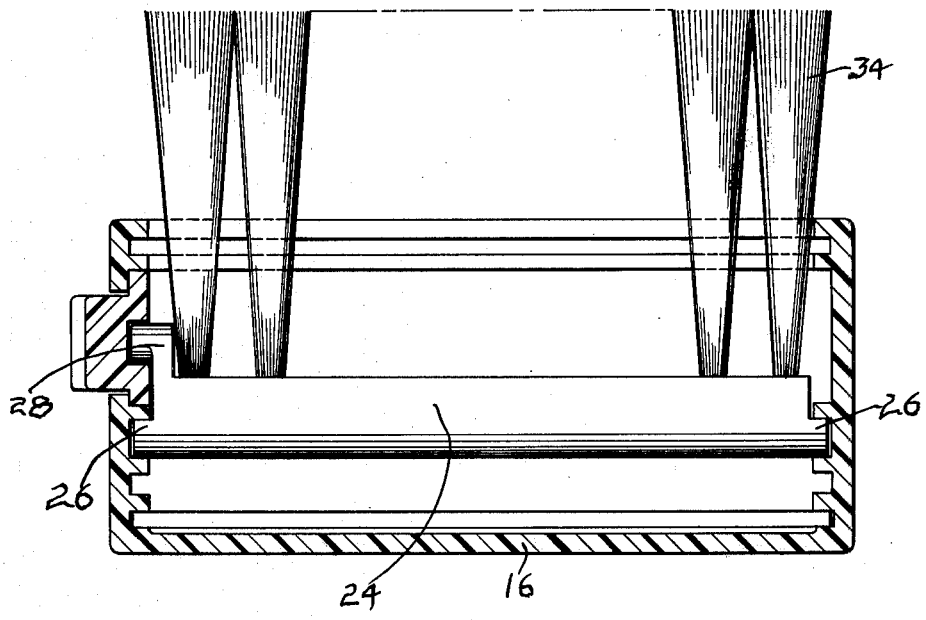
FIG. 5 is a transverse section of the device as shown in FIG. 4.

Referring more in detail to the drawings, FIGS. 1 to 5, inclusive, illustrate the basic form of the invention. The housing 10 is of a generally flat oval shape with oval sides 12 and 14. A wide wall portion 16 curves around the back and ends of the sides leaving an open front. The wall 16 is provided with a spaced inside portion 18 which forms a space 20 therebetween. A sliding articulated cover 22 closes the housing 10, the cover 22 being adapted to slide into the space 20 in open position.

The brush comprises a plurality of spaced, transverse bars 24 each with a pivot 26 extending integrally from the ends. The sides 12 and 14 of the housing are provided with suitable pivot openings for receiving the pivot ends of the bars 24. At one end, each bar 24 is provided with a second integral pivot 28, see FIG. 5, located above the pivot point 26. I now provide a flat operating member 30 mounted for longitudinal reciprocation inside of the housing. The member 30 is provided with a plurality of slots 32 adapted to engage the second pivots 28 of the bars 24. The brush bristles 34 are in conventional tufts mounted in rows on each of the bars 24, see FIG. 2. The member 30 is provided with a manually engageable portion 36 which extends through an opening at one side to allow sliding movement.

The operation of the brush is now obvious. The cover 22 is slid back to expose the bristles. The portion 36 is operated to move the member 30 longitudinally. This pivots the bars 24 90° into the position shown in FIGS. 2 and 4. The bristles are in erect position. As the sliding member 30 reaches the correct position it snaps over a detent 38, FIG. 4, on the housing wall to releasably lock the brush in operating position.

Reversely, the portion 36 is engaged to slide the member 30 in the opposite direction past the detent 38. This pivots the bars 24 and causes the bristles 34 to lie flat, FIG. 3. The cover 22 can then be slid into place to produce a thin flat compact unit which completely houses the brush and protects the bristles and keeps them clean while traveling.

Figure 6:
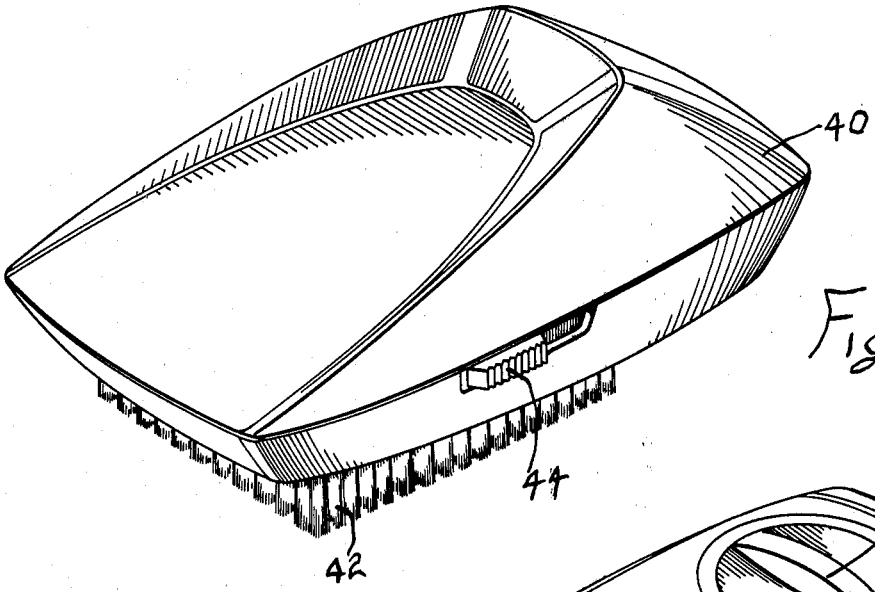
FIGS. 6, 7 and 8 are perspective views of the invention in design variations of the housing.
Figure 7:
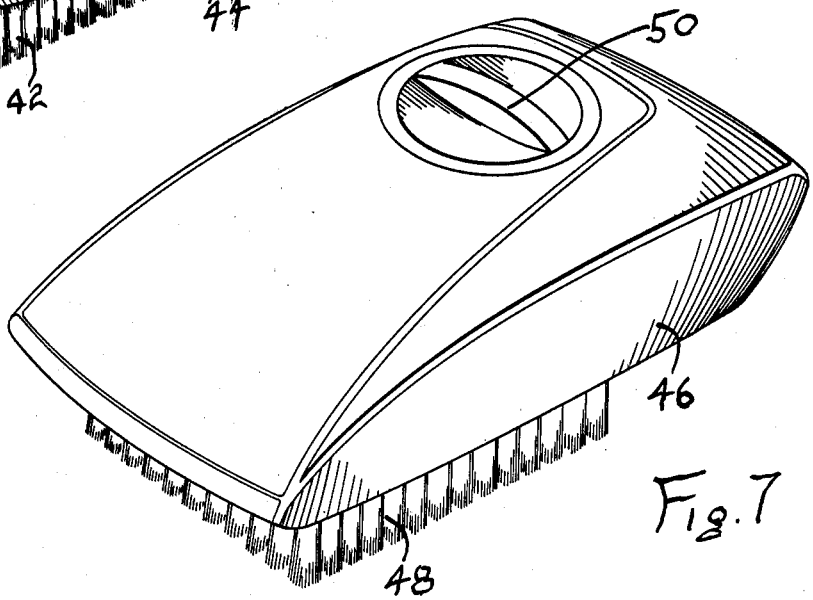
Figure 8:
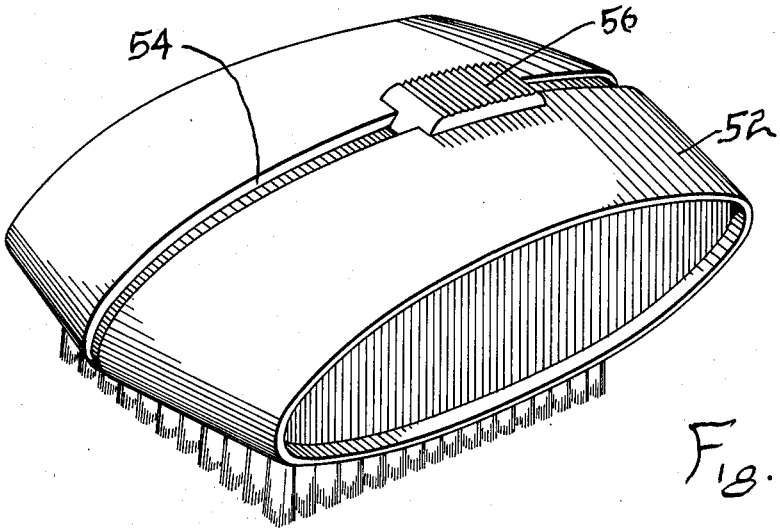

This basic invention lends itself to many variations in the shape and design of the housing. Occasionally, the housing design may necessitate slight changes in the operating construction. For example, FIG. 6 illustrates a more rectangular housing 40 with the bristles 42 and the finger engageable member 44. This form operates as the first form but looks more modern. In the form shown in FIG. 7, the housing 46 and bristles 48 are similar to the first form. However, here the slide member (not shown) is operated from the member 50 at the top of the housing and which requires a turning action. A conventional lever bar can connect the member 50 with the operating slide member. In FIG. 8 the housing 52 is provided with a longitudinal slot 54. The operating manually engageable member 56 slides in the slot 54 to operate the device as in the first form. These are variations in the housing design necessitating slight variations in the position of the manually engageable member. Internally, the device operates in the same manner as in the first form.

Figure 9:
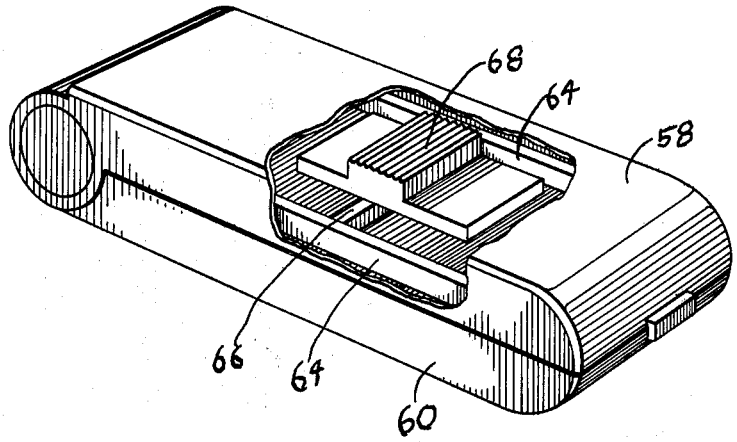
FIG. 9 is a perspective view, partly broken away, of another form of housing in closed position.
Figure 10:
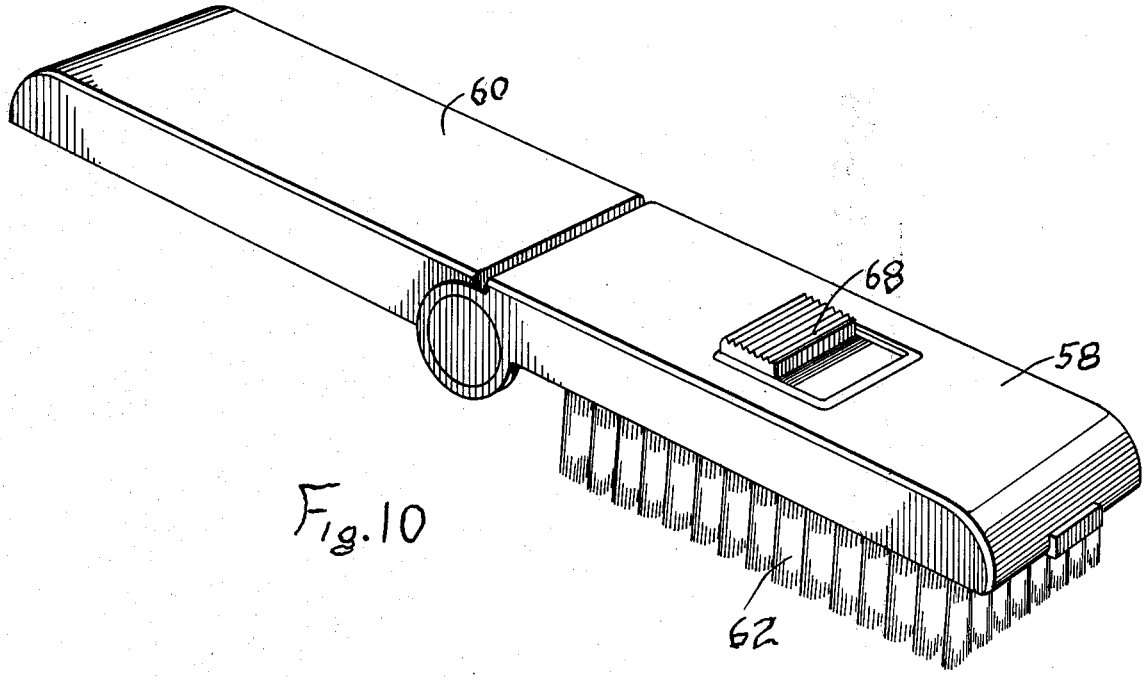
FIG. 10 is a perspective view of the form shown in FIG. 9 in open position.

FIGS. 9 and 10 illustrate the device in a different form of housing. Here the housing comprises an elongated rectangular base 58 pivoted at one end to a cover 60. The bristles 62 are mounted as in the first form, but this form is provided with longitudinal pivot slide members 64 at each side. A transverse bar 66 connects the members 64, and a manually engageable member 68 extends from the bar 66 through the back wall 58. This form allows the cover 60 to swing out as in FIG. 10 to permit a better grip on the brush in use.

I have thus provided a travel brush construction in which the brush is housed in a case which is flat and compact. This is possible because of the pivot action of the bristles. The construction is simple and fairly easy and economical to manufacture and assemble. Other advantages of the present invention will be readily apparent to a person skilled in the art.

I claim:

1. A travel hair brush comprising a housing having opposed spaced sides, a plurality of transverse bars extending between said sides, said bars being pivotally mounted on said sides, a row of bristles mounted on each of said bars, and means for pivoting said bars through substantially 90°, whereby said bristles are inclined to a generally flat position in said housing when said bars are pivoted in one direction and said bristles stand vertically for use as a hair brush when said bars are pivoted in the opposite direction, said housing also including a back wall curved around the back and ends of the sides, an inside portion extending along and spaced from said back wall, an articulated cover slidably guided in said sides from an open position on one side of said bars in the space along said back wall to a closed position on the opposite side of said bars and in contact with said bristles to press bristles toward said back wall in compressed position.

2. A travel brush as in claim 1, wherein said means includes a manually engageable portion extending from said housing for operating said means.

3. A travel brush as in claim 1, wherein said means includes an elongated slidable member connected to said bars.

4. A travel brush as in claim 3, wherein said means includes a manually engageable portion extending from said member for manually sliding said member.

5. a travel brush as in claim 1, wherein each of said bars is provided at one end with a second pivot above said main pivot, said member being pivotally connected to said second pivots on each of said bars.

* * * * *